US010124269B2

(12) United States Patent
Uno

(10) Patent No.: US 10,124,269 B2
(45) Date of Patent: Nov. 13, 2018

(54) ASSEMBLY BLOCK WITH SERVOMOTOR, AND ASSEMBLY BLOCK KIT

(71) Applicant: ARTEC CO., LTD., Osaka (JP)

(72) Inventor: Yasumasa Uno, Osaka (JP)

(73) Assignee: ARTEC CO., LTD., Osaka (JP)

( * ) Notice: Subject to any disclaimer, the term of this patent is extended or adjusted under 35 U.S.C. 154(b) by 0 days.

(21) Appl. No.: 15/279,623

(22) Filed: Sep. 29, 2016

(65) Prior Publication Data

US 2017/0014726 A1 Jan. 19, 2017

Related U.S. Application Data

(63) Continuation of application No. PCT/JP2014/059463, filed on Mar. 31, 2014.

(51) Int. Cl.

| | |
|---|---|
| ***A63H 33/04*** | (2006.01) |
| ***A63H 33/08*** | (2006.01) |
| ***A63H 29/22*** | (2006.01) |

(52) U.S. Cl.

CPC ..... *A63H 33/042* (2013.01); *A63H 29/22* (2013.01); *A63H 33/08* (2013.01)

(58) Field of Classification Search

CPC ..... A63H 29/22; A63H 33/08; A63H 33/042
USPC ..... 446/90, 91, 102, 103, 104
See application file for complete search history.

(56) References Cited

U.S. PATENT DOCUMENTS 3,484,983 A * 12/1969 Fischer ..... A63H 33/042 446/90
3,597,873 A * 8/1971 Fischer ..... A63H 33/042 446/90
3,608,233 A * 9/1971 Masaru ..... A63H 33/042 446/118

(Continued)

FOREIGN PATENT DOCUMENTS

JP 2-66743 5/1990
JP 7-61382 7/1995

(Continued)

OTHER PUBLICATIONS

International Search Report dated Jul. 1, 2014 in International (PCT) Application No. PCT/JP2014/059463.

(Continued)

*Primary Examiner* — Melba Bumgarner
*Assistant Examiner* — Joseph B Baldori
(74) *Attorney, Agent, or Firm* — Wenderoth, Lind & Ponack, L.L.P.

(57) ABSTRACT

An assembly block with a servomotor includes: a block main body having at least one connector including a protrusion or a recessed portion; a servomotor; and a rotation shaft which is configured to be rotationally driven by the servomotor. The assembly block with the servomotor is connectable to a basic block by fitting the at least one connector of the block main body to one or more connectors of the basic block. The assembly block with the servomotor includes a rotary block which is defined as a polyhedron, (Continued)

has, on a surface thereof, at least one connector including a recessed portion or a protrusion, and is fixed to one end of the rotation shaft such that the rotary block can rotate. An assembly block kit includes the assembly block with the servomotor, and basic blocks connectable to the assembly block.

3 Claims, 14 Drawing Sheets

(56) References Cited

U.S. PATENT DOCUMENTS 4,224,758 A * 9/1980 Fischer ..... A63H 33/042 446/90
4,253,268 A * 3/1981 Mayr ..... A63H 33/042 16/224
4,764,144 A 8/1988 Lyman
4,813,903 A * 3/1989 Furukawa ..... A63H 33/042 446/103
4,861,306 A 8/1989 Bolli et al.
5,241,875 A * 9/1993 Kochanneck ..... B25J 9/08 180/8.6
5,259,803 A * 11/1993 Lyman ..... A63H 31/00 446/103
5,346,420 A * 9/1994 Glickman ..... A63H 33/042 446/124
5,411,428 A * 5/1995 Orii ..... A63H 33/042 446/102
5,738,558 A 4/1998 Zimmer et al.
5,850,762 A * 12/1998 Kochanneck ..... B25J 9/08 180/65.1
6,561,866 B1 5/2003 Lee
6,636,781 B1 * 10/2003 Shen ..... B08B 9/045 318/568.11
6,679,780 B1 * 1/2004 Shih ..... A63F 9/1204 273/156
6,893,316 B2 * 5/2005 Maxwell ..... A63H 33/042 446/103
7,708,615 B2 * 5/2010 Munch ..... A63H 33/042 446/484
8,888,552 B2 * 11/2014 Wizenberg ..... A63H 33/086 446/102
9,168,464 B2 * 10/2015 Karunaratne ..... A63H 33/086
2008/0160873 A1 7/2008 Yoneda
2009/0149109 A1 * 6/2009 Yoneda ..... B25J 9/1615 446/90
2009/0247045 A1 * 10/2009 Pettey ..... A63H 33/042 446/484
2012/0122059 A1 * 5/2012 Schweikardt ..... A63H 33/04 434/118
2013/0109267 A1 * 5/2013 Schweikardt ..... A63H 33/04 446/85
2013/0183882 A1 * 7/2013 Oschuetz ..... A63H 33/042 446/90
2013/0203316 A1 8/2013 Uno
2013/0217294 A1 * 8/2013 Karunaratne ..... A63H 33/22 446/90
2016/0361662 A1 * 12/2016 Karunaratne ..... A63H 33/042
2017/0007939 A1 * 1/2017 Choi ..... A63H 31/00
2017/0144083 A1 * 5/2017 Kæregaard ..... A63H 33/042
2017/0173485 A1 * 6/2017 Liotta ..... A63H 33/042

FOREIGN PATENT DOCUMENTS

JP 63-68190 3/1998
JP 10-108985 4/1998
JP 2008-161350 7/2008
WO 2013/118238 8/2013

OTHER PUBLICATIONS

Artec Block Seihin Catalog, Artec, Jun. 13, 2013 (received dated), p. 5, Catalog that was distributed by International Tokyo Toy Show 2013.
Artec Block Robo ga TV de Shokai saremashita—YouTube, [online], YouTube, Nov. 14, 2013, retrieved Jun. 9, 2014, particularly, 'Servomotor (3kg•cm)' appearing in the play time 3:20 of the video, Internet < URL http://www.youtube.com/watch?v=G8_eaKoGNA8>.

* cited by examiner

ASSEMBLY BLOCK WITH SERVOMOTOR, AND ASSEMBLY BLOCK KIT

CROSS REFERENCE TO RELATED APPLICATIONS

This application is a continuation of International Application PCT/JP2014/059463 filed on 31 Mar. 2014, the entire teachings of which are incorporated herein by reference.

FIELD

The present invention relates to an assembly block with a servomotor, which is assembled by fitting protrusions into recessed portions and is provided with a servomotor, and an assembly block kit including the assembly block with the servomotor.

BACKGROUND

Assembly blocks for play and learning have been widespread for a long time. The assembly blocks are formed of polyhedrons, such as rectangular parallelepipeds, cubes, triangle poles, etc., having protrusions and recessed portions at surfaces of the polyhedrons, and are connected to each other by fitting the protrusions into the recessed portions to be assembled into a desired shape. In recent years, assembly blocks which are provided with motors and cause the motors to drive movable parts thereof have gained popularity.

For example, Japanese Examined Patent Publication No. H7-61382 (Patent Literature 1) proposes an assembly block kit of a locomotive which is provided with a motor and travels along rack rails. A gear is mounted to a drive shaft driven by the motor, and the gear is engaged with the rack rails and rotated to cause the locomotive to travel.

Meanwhile, Japanese Laid-Open Patent Publication No. H10-108985 (Patent Literature 2) proposes an assembly block including: function exhibiting means that exhibits functions such as a servomotor, a buzzer, etc.; control means that controls the function exhibiting means; and communication means that communicates with another assembly block through a network, thereby realizing complicated actions with a simple wiring. Patent Literature 2 provides an embodiment in which caterpillars of a bulldozer are driven by a motor via a gear.

In Patent Literature 1, however, since the use of the motor is limited to the locomotive, a user has to purchase the whole kit of the locomotive. Regarding the assembly block disclosed in Patent Literature 2, a user has to purchase one by one special parts prepared for different purposes of rotation shafts rotated by the motor.

The present invention is made in view of the above problems, and an object of the present invention is to provide: an assembly block with a servomotor which can be used in various ways, without requiring special parts used for rotation shafts only; and an assembly block kit including the assembly block with the servomotor.

SUMMARY

An assembly block with a servomotor according to the present invention which is made to solve the above problems includes: a block main body having, on a surface thereof, at least one connection means including a protrusion or a recessed portion; a servomotor provided in the block main body; and a rotation shaft which is rotationally driven by the servomotor. The assembly block with the servomotor is connectable to a basic block which is formed of a rectangular parallelepiped, and has, on surfaces thereof, connection means comprising at least one protrusion and at least one recessed portion by fitting the connection means of the assembly block to the connection means of the basic block. The assembly block with the servomotor further includes a rotary block which is fixed to one end of the rotation shaft and rotates together with the rotation shaft. The rotary block is formed of a polyhedron, and has, on a surface thereof, connection means including a recessed portion or a protrusion.

As described above, in the assembly block with the servomotor according to the present invention, since the polyhedron block having a protrusion or a recessed portion is provided at one end of the rotation shaft driven by the servomotor, the basic block can be directly connected to the rotation shaft.

Preferably, the rotary block has at least one side surface parallel to the rotation shaft, and has at least one connection means on the side surface. By so doing, the rotary block can be directly connected to the basic block located in the direction perpendicular to the rotation shaft.

The assembly block with the servomotor according to the present invention further includes a floating block which is formed of a polyhedron, has, on a surface thereof, connection means including a protrusion or a recessed portion, and is rotatably supported by the block main body so as to rotate around an extension of the other end of the rotation shaft. The floating block preferably rotates independently of the block main body and the rotation shaft.

By so doing, only the block main body rotates when both the rotary block and the floating block are fixed, the block main body and the floating block rotate when only the rotary block is fixed, and only the rotary block rotates when only the floating block is fixed. Thus, three types of rotation modes can be provided.

Furthermore, when the rotary block is connected to one basic block and the floating block is connected to another basic block, the rotary block and the floating block are rotatable independently from each other and therefore can be separately operated. Thus, connection of the rotary block and the floating block to the basic block is facilitated.

Preferably, the floating block has at least one side surface parallel to the rotation shaft, and has at least one connection means on the side surface. By so doing, the floating block can be directly connected to the basic block located in the direction perpendicular to the rotation shaft.

An assembly block kit according to the present invention includes: a basic block which is formed of a rectangular parallelepiped, and has, on surfaces thereof, connection means including at least one protrusion and at least one recessed portion; and the assembly block with the servomotor described above. Each of the surfaces of the basic block is formed of a rectangle including one or a plurality of square sections (hereinafter also referred to simply as "section") arranged side by side, and each section has a length of P along each side. The connection means of the basic block is provided in the center of the section, and includes at least one set of a protrusion and a recessed portion which are respectively provided in two sections not opposed to each other. The connection means of the assembly block with the servomotor is formed to be fitted to the protrusion or the recessed portion of the basic block, and the connection means of the block main body has a connection direction perpendicular to the rotation shaft. The connection means on the side surface of the floating block includes at least one protrusion and at least one recessed portion. When the connection direction of the connection means of the block main body is made coincide with that of the connection means on the side surface of the floating block and these connection means are viewed in parallel in the connection direction, a rectangle (hereinafter also referred to as "first rectangle") has a longitudinal side and a lateral side each having a length equal to an integral multiple of the P. The rectangle has, as a diagonal line, a line segment connecting the center of the connection means of the block main body and the center of the connection means on the side surface of the floating block, and has the longitudinal side parallel to the rotation shaft.

As described above, each surface of the basic block is formed of the rectangle including one or a plurality of the sections arranged side by side, the connection means of the basic block is provided in the center of the section, the protrusion and the recessed portion of the basic block are respectively provided in two sections not opposed to each other, and the lengths of the longitudinal side and the lateral side of the first rectangle in the connection means of the block main body and the floating block are equal to integral multiples of the pitch P of the connection means of the basic block. Therefore, the connection means of the block main body and the connection means of the floating block can be connected to each other by using one or a plurality of basic blocks.

In the assembly block kit according to the present invention, the connection means on the side surface of the rotary block of the assembly block with the servomotor preferably includes at least one protrusion and at least one recessed portion, and when a connection direction of the connection means on the side surface of the rotary block is made coincide with that of the connection means on the side surface of the floating block and these connection means are viewed in parallel in the connection direction, a rectangle (hereinafter also referred to as "second rectangle") preferably has a longitudinal side and a lateral side each having a length equal to an integral multiple of the P. The rectangle has, as a diagonal line, a line segment connecting the center of the connection means on the side surface of the rotary block and the center of the connection means on the side surface of the floating block, and has the longitudinal side parallel to the rotation shaft.

As described above, when the connection directions of the connection means on the side surfaces of the rotary block and the floating block are made coincide with each other, the lengths of the longitudinal side and the lateral side of the second rectangle are equal to integral multiples of the P. Therefore, the connection means on the side surface of the rotary block and the connection means on the side surface of the floating block can be connected to each other by using the basic block.

The "connection direction" indicates, regarding a protrusion, a direction in which the protrusion protrudes, and indicates, regarding a recessed portion, a direction in which a protrusion is fitted into the recessed portion. The "integral multiple" includes 0 times.

The "two sections not opposed to each other" are two sections that are not superposed in a front-to-back direction when viewed in a direction perpendicular to a plane including one of the two sections.

As described above, according to the assembly block with the servomotor and the assembly block kit of the present invention, the assembly block can be directly connected to the rotary block mounted to the rotation shaft, a user can enjoy works having rotating parts without purchasing gears, tires, rods for forming cranks, etc.

DESCRIPTION OF EMBODIMENTS

Figure 1:
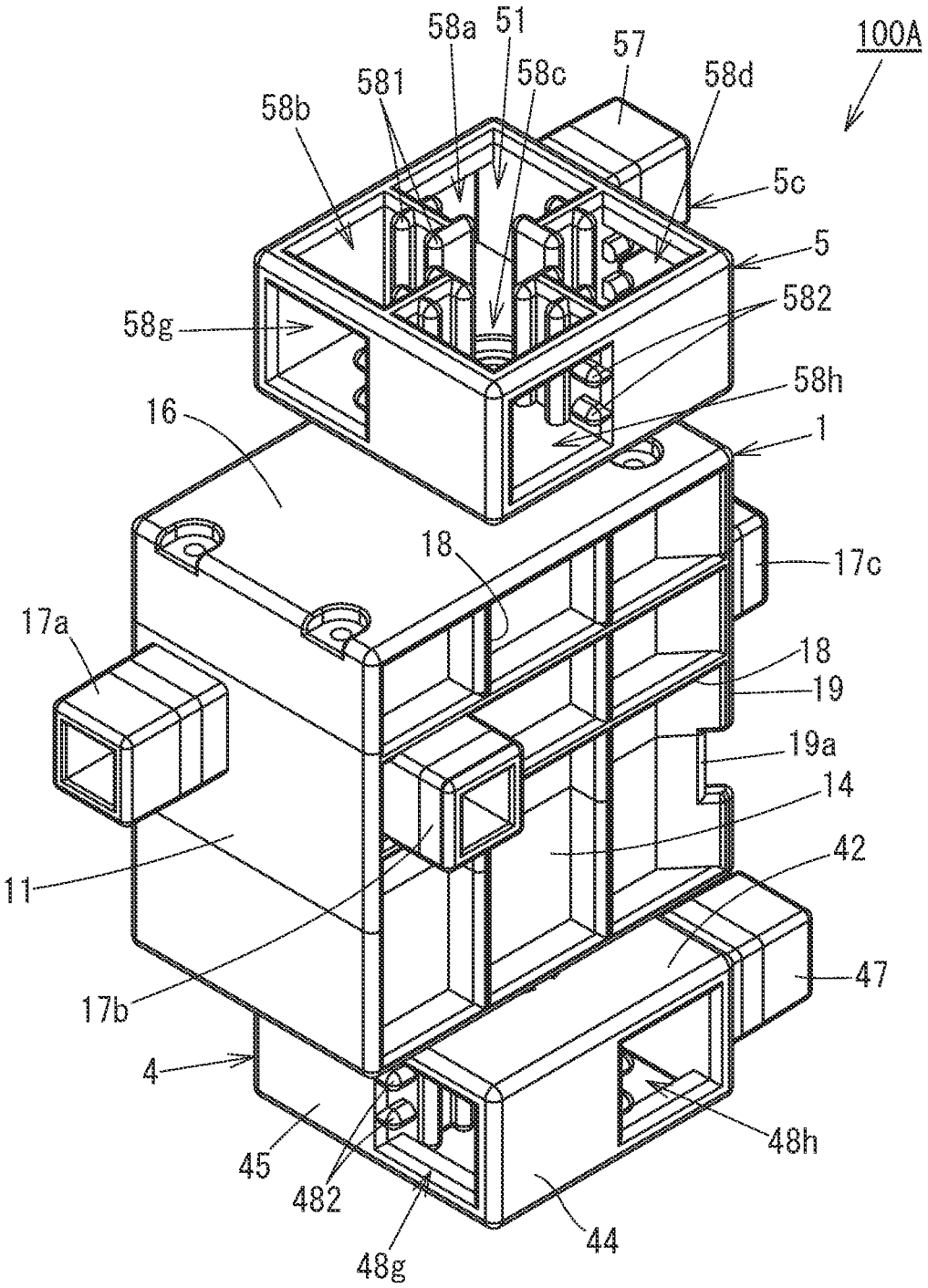
FIG. 1 is a perspective view of an assembly block with a servomotor according to an embodiment of the present invention.
Figure 2:
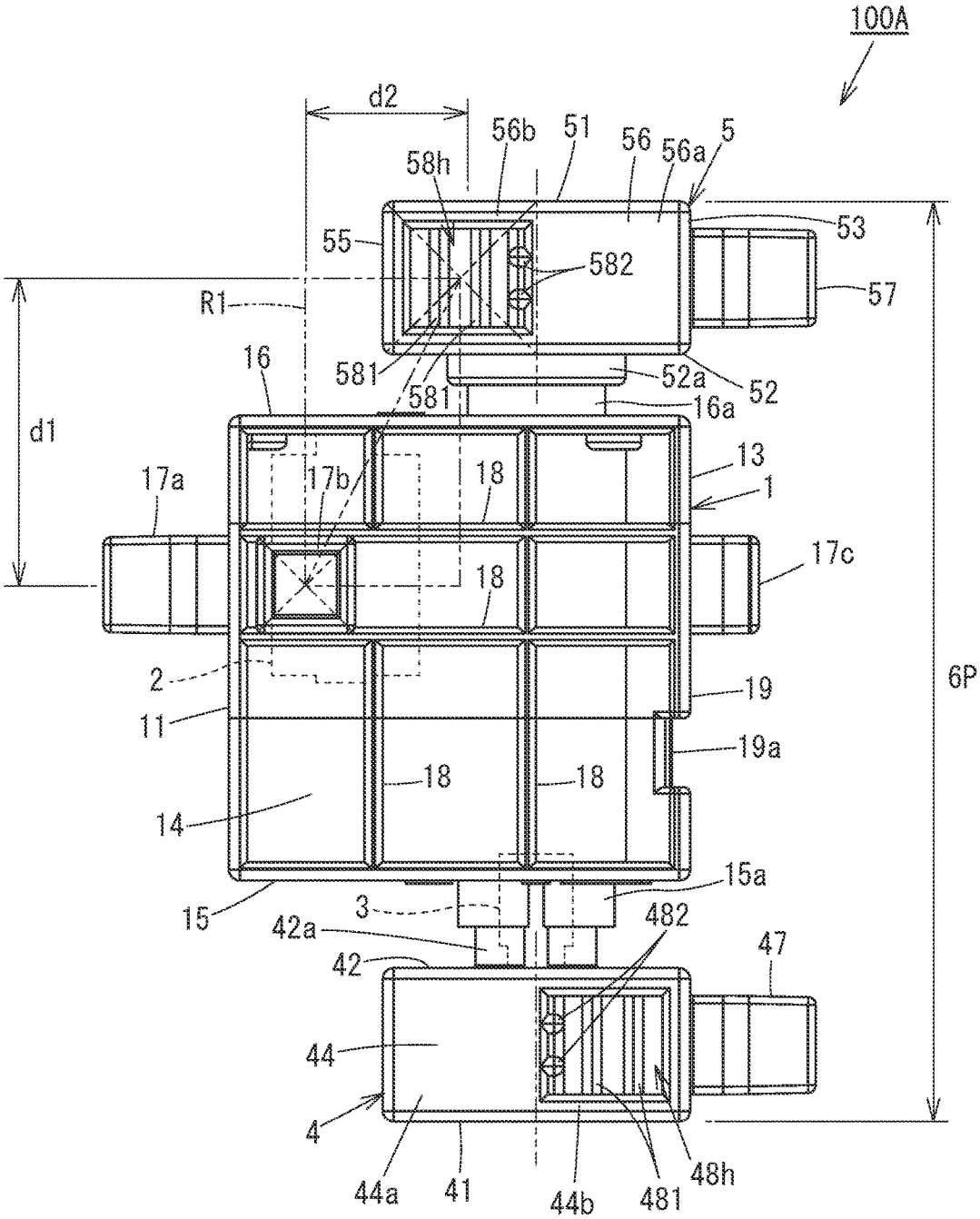
FIG. 2 is a front view of the assembly block with the servomotor shown in FIG. 1.
Figure 3:
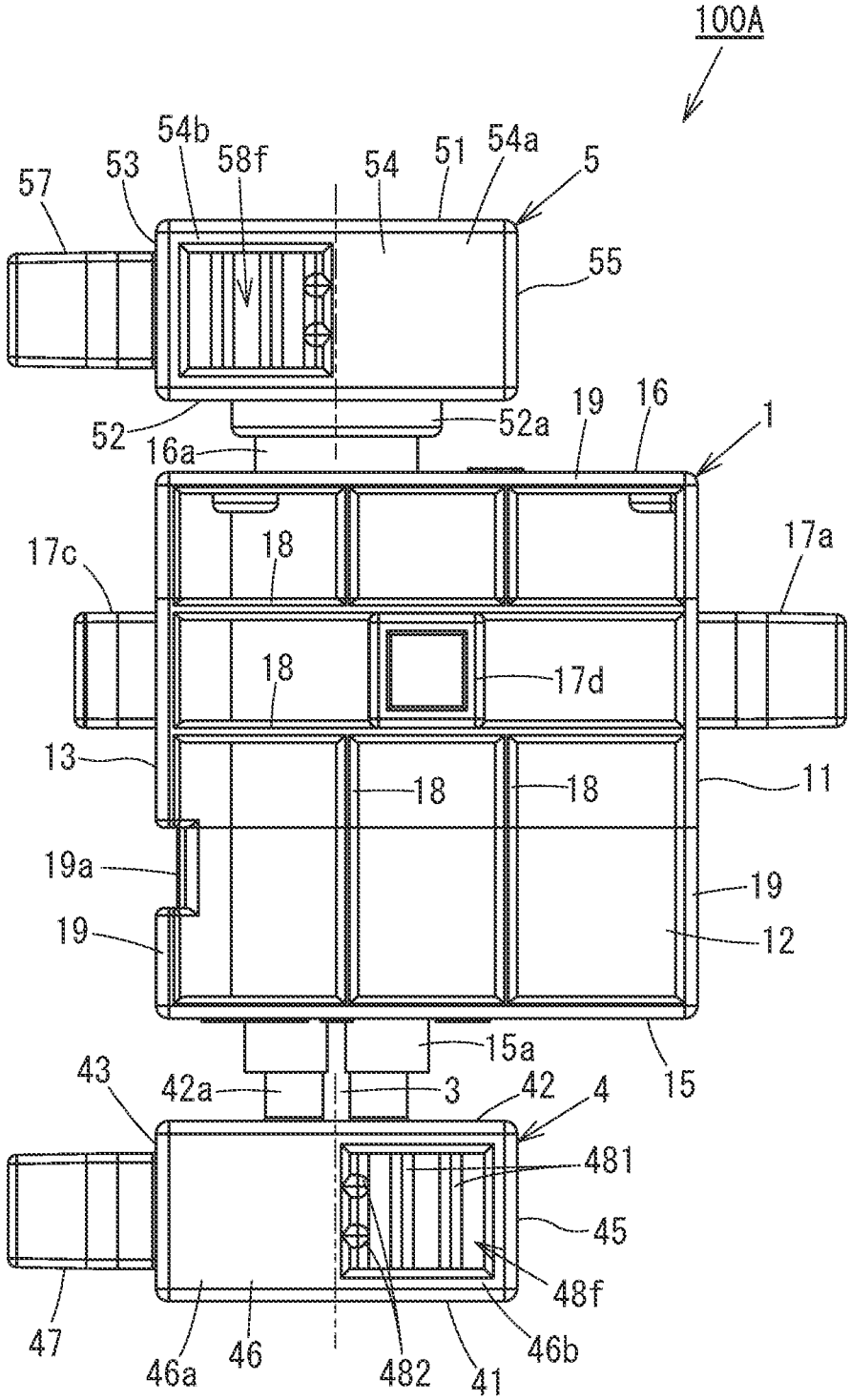
FIG. 3 is a back view of the assembly block with the servomotor shown in FIG. 1.

Hereinafter, an embodiment of the present invention will be described with reference to the drawings as necessary. FIGS. 15A to 15H show an assembly block kit 1000 (no reference sign in the drawings) according to the present invention. The assembly block kit 1000 includes: an assembly block 100A with a servomotor (hereinafter also referred to simply as "assembly block 100A"); basic blocks 200, 300, 400, 500, 600, and 700 and an accessory block 800 which are connectable to the assembly block 100A. Each of the surfaces of the basic blocks 200 to 700 has a rectangular shape in which square sections, each having a length of P along each side, are arranged side by side, and each basic block has at least one protrusion and at least one recessed portion each provided in the center of the section. Since the protrusion and the recessed portion are each provided in the center of the section, the sections can be accurately superposed on each other. In addition, each of the protrusions of the basic blocks 200 to 700 has a square cross section, and can be fitted into the recessed portion and fixed in an attitude rotated by 90 degrees each time with respect to the recessed portion.

It is noted that the assembly block with the servomotor and the assembly block kit according to the present invention are not limited to the embodiment described hereinafter.

Figure 15A:
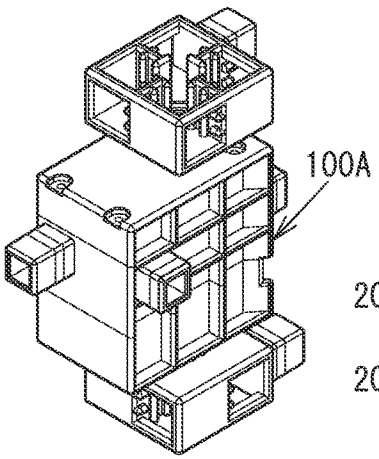
FIG. 15A is a perspective view showing an assembly block with a servomotor included in an assembly block kit according to the present invention.
Figure 15B:
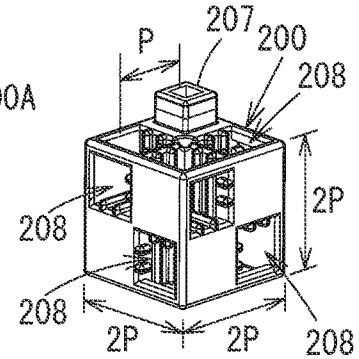
FIGS. 15B to 15G are respectively a perspective view showing a basic block included in an assembly block kit according to the present invention.
Figure 15C:
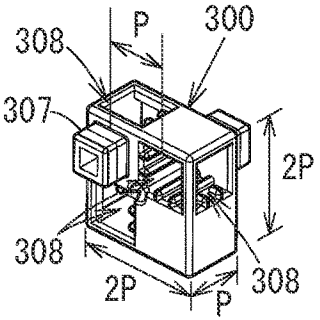
Figure 15D:
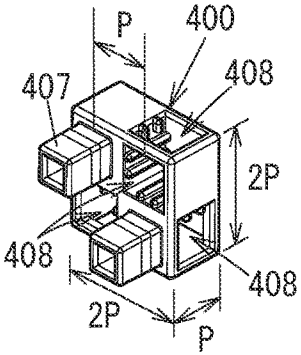
Figure 15E:
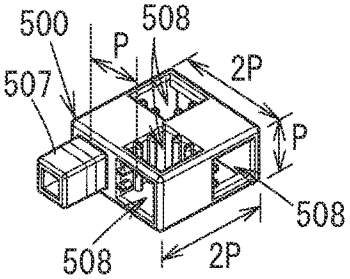
Figure 15F:
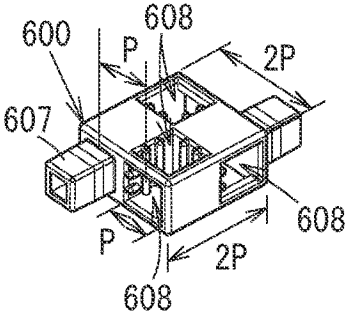
Figure 15G:
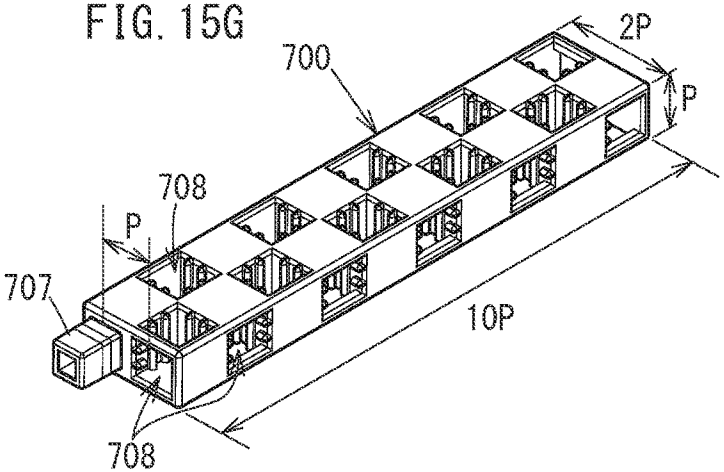
Figure 15H:
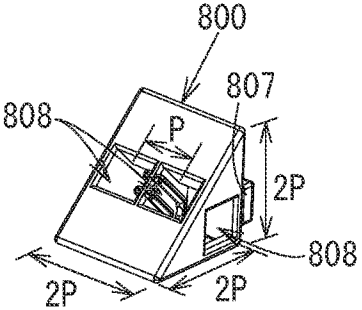
FIG. 15H is a perspective view showing an accessory block included in an assembly block kit according to the present invention.

As shown in FIG. 15B, the basic block 200 is formed of a cube, and each of the surfaces thereof has a square shape including four sections arranged side by side. The basic block 200 has a protrusion 207 and recessed portions 208 provided in non-opposed sections.

As shown in FIGS. 15C to 15F, each of the basic blocks 300 to 600 is formed of a rectangular parallelepiped, and has four rectangular surfaces each including two sections arranged side by side, and two square surfaces each including four sections arranged side by side. The basic blocks 300 to 600 include protrusions 307, 407, 507, and 607, and recessed portions 308, 408, 508, and 608 formed in the sections not opposed to the protrusions 307, 407, 507, and 607, respectively.

The basic block 700 is formed of an elongated rectangular parallelepiped having dimensions of P×2 P×10 P for the length, the width, and the height, respectively, and includes a protrusion 707, and a plurality of recessed portions 708 formed in the sections not opposed to the protrusion 707.

The accessory block 800 is formed of a triangle pole having two square surfaces each including four sections arranged side by side.

The basic blocks 200 to 700 and the accessory block 800 are configured such that the pitch between the centers of adjacent protrusions or recessed portions in the same surface is P.

As shown in FIGS. 1 to 8, an assembly block 100A with a servomotor includes: a block main body 1; a servomotor 2 (refer to FIG. 8) provided inside the block main body 1; a rotation shaft 3 (refer to FIG. 8) that is rotationally driven by the servomotor 2 via a gear; a rotary block 4 fixed to one end of the rotation shaft 3; a floating block 5 rotatably supported by the block main body 1 at the other end of the rotation shaft 3; a control board 6 provided inside the block main body 1; and an electric wiring 7 (refer to FIG. 12) that transmits power and information for controlling the servomotor 2 to the servomotor 2 and the control board 6. In FIGS. 1 to 8, illustration of the electric wiring 7 is omitted.

The block main body 1 is formed of a substantially rectangular parallelepiped, and includes a first surface 11, a second surface 12, a third surface 13, and fourth surface 14 which are parallel to the rotation shaft 3, and a fifth surface 15 and a sixth surface 16 which are perpendicular to the rotation shaft 3. Each of the first to sixth surfaces 11 to 16 has a rectangular shape, and the first to fourth surfaces have rectangular cylindrical protrusions 17*a*, 17*b*, 17*c*, and 17*d*, respectively. Each of the protrusions 17*a*, 17*b*, 17*c*, and 17*d* has an outer peripheral surface and an inner peripheral surface which are perpendicular to the protruding direction and have square cross sections.

Figure 12:
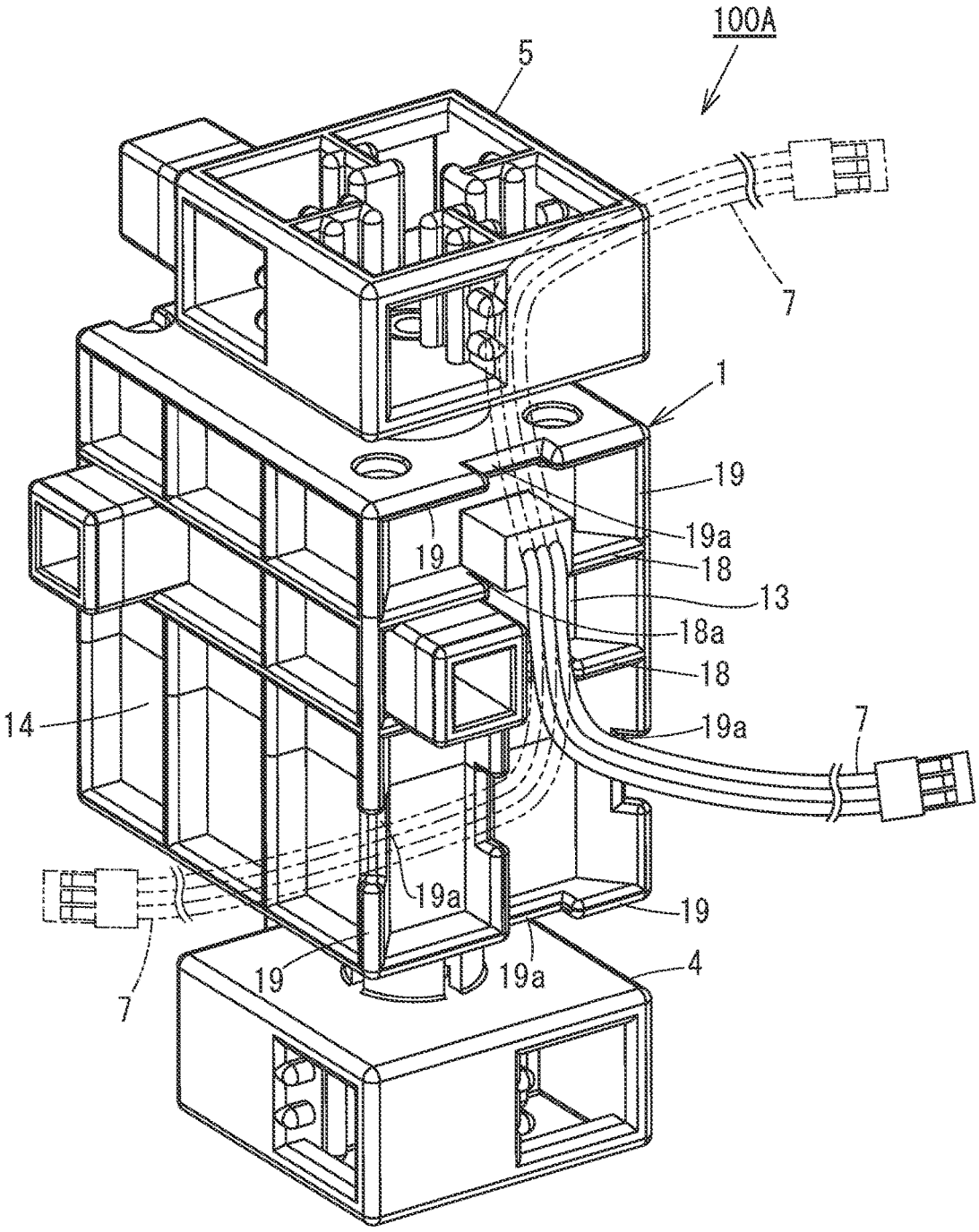
FIG. 12 is a perspective view showing a state where an electric wiring is housed in cutout parts.

The first surface 11 is formed of a flat plane. In each of the second to fourth surfaces, a rib 19 is provided along an outer periphery thereof, and longitudinally and laterally intersecting ribs 18 are formed inside the surface. When any of the basic blocks 200 to 800 is connected to any of the second to fourth surfaces, the surface of the assembly block is in contact with tip edges of the ribs 18 and 19. Since the electric wiring 7 extends from the second surface 12 as shown in FIG. 12, the ribs 18 and 19 of the second surface 12 have cutout parts 18*a* and 19*a* for housing the electric wiring 7 to prevent the electric wiring 7 from being a hindrance when any of the basic blocks 200 to 800 is connected to the second surface 12.

The servomotor 2 drives the rotation shaft 3 in accordance with power supplied through the electric wiring 7 and information transmitted from the electric wiring 7 through the control board 6. On the fifth surface 15 of the block main body 1 at one end side of the rotation shaft 3, the rotary block 4 which is fixed to the rotation shaft 3 and rotates together with the rotation shaft 3 is provided.

The rotary block 4 is formed of a flat rectangular parallelepiped, and includes: an outer surface 41 and an inner surface 42 which have square shapes and are perpendicular to the rotation shaft 3; side surfaces 43 to 46 which are parallel to the rotation shaft 3 and have rectangular shapes each having a longitudinal length of P and a lateral length of 2 P; and four partition walls 49*a*, 49*b*, 49*c*, and 49*d* which partition the internal space of the rotary block 4 longitudinally and laterally in a plan view. The rotary block 4 is, in the center of the inner surface 42, fixed to an end of the rotation shaft 3 so as to rotate together with the rotation shaft 3.

Figure 7:
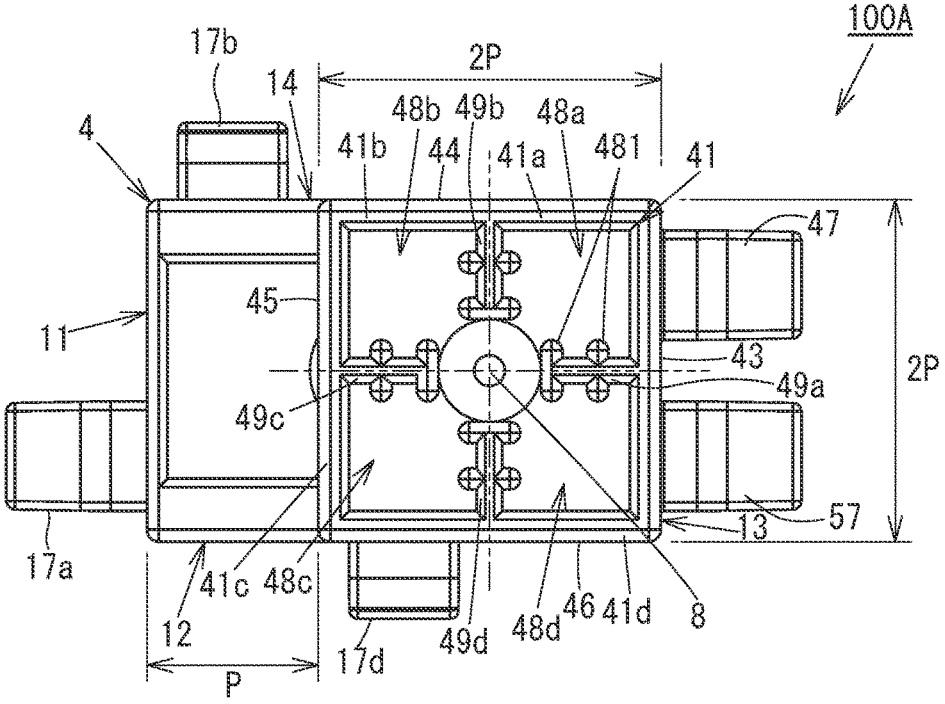
FIG. 7 is a bottom view of the assembly block with the servomotor shown in FIG. 1.

As shown in FIG. 7, the outer surface 41 is formed of a square having a length of 2 P along each side, and has four recessed portions 48*a*, 48*b*, 48*c*, and 48*d* partitioned by the partition walls 49*a* to 49*d*. The most part of the outer surface 41 is opened. Each of the partition walls 49*a* to 49*d* is provided with, on both sides thereof, two lines of ribs 481 extending in the connection direction of the recessed portions 48*a* to 48*d* (the direction in which the protrusions are inserted into the recessed portions 48*a* to 48*d*, i.e., the up-down direction in FIGS. 2 to 5), and is provided with, on one side thereof, two lines of ribs 482 extending in the connection direction of the recessed portions 48*e* to 48*h* described below (the direction in which the protrusions are inserted into the recessed portions 48*e* to 48*h*). The outer surface 41 can be equally divided into four square sections 41*a*, 41*b*, 41*c*, and 41*d* each having a length of P along each side, the boundaries of which are indicated by virtual lines (alternate long and two short dashes lines) in FIG. 7, and the recessed portions 48*a* to 48*d* are configured such that the protrusions to be fitted therein are located in the centers of the sections 41*a* to 41*d*, respectively, by the ribs 481 and 482 and the direction of insertion of the protrusions is perpendicular to the outer surface 41. The pitch between the adjacent recessed portions among the recessed portions 48*a* to 48*d* is P.

The inner surface 42 is opposed to the block main body 1, and includes, in the center thereof, a cylindrical cover 42*a* to be fitted to a cylindrical cover 15*a* of the fifth surface 15 of the block main body 1. The rotary block 4 is fixed to the rotation shaft 3 by means of a fixing screw 8 penetrating through the center of the inner surface 42.

Figure 4:
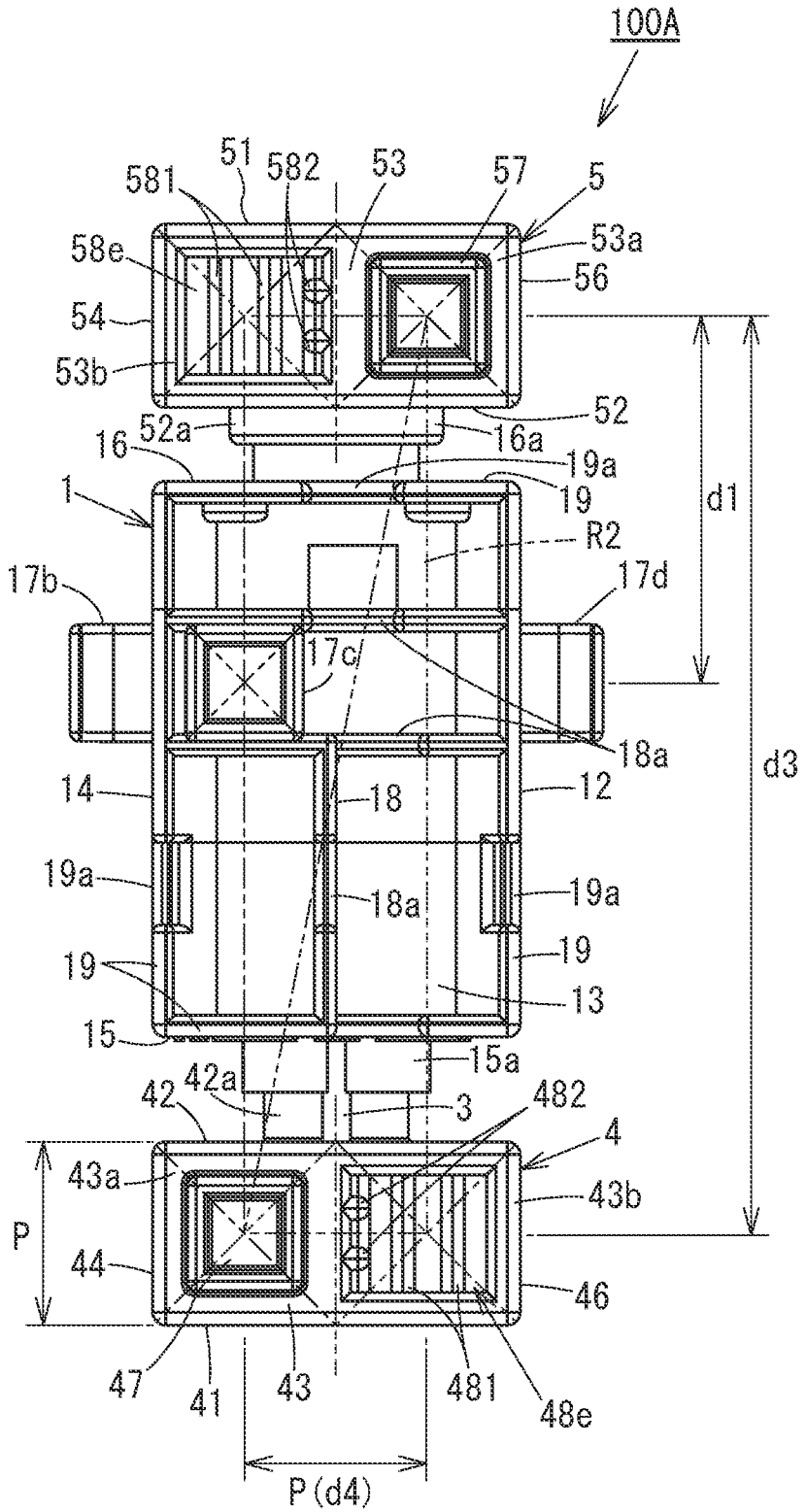
FIG. 4 is a right side view of the assembly block with the servomotor shown in FIG. 1.
Figure 5:
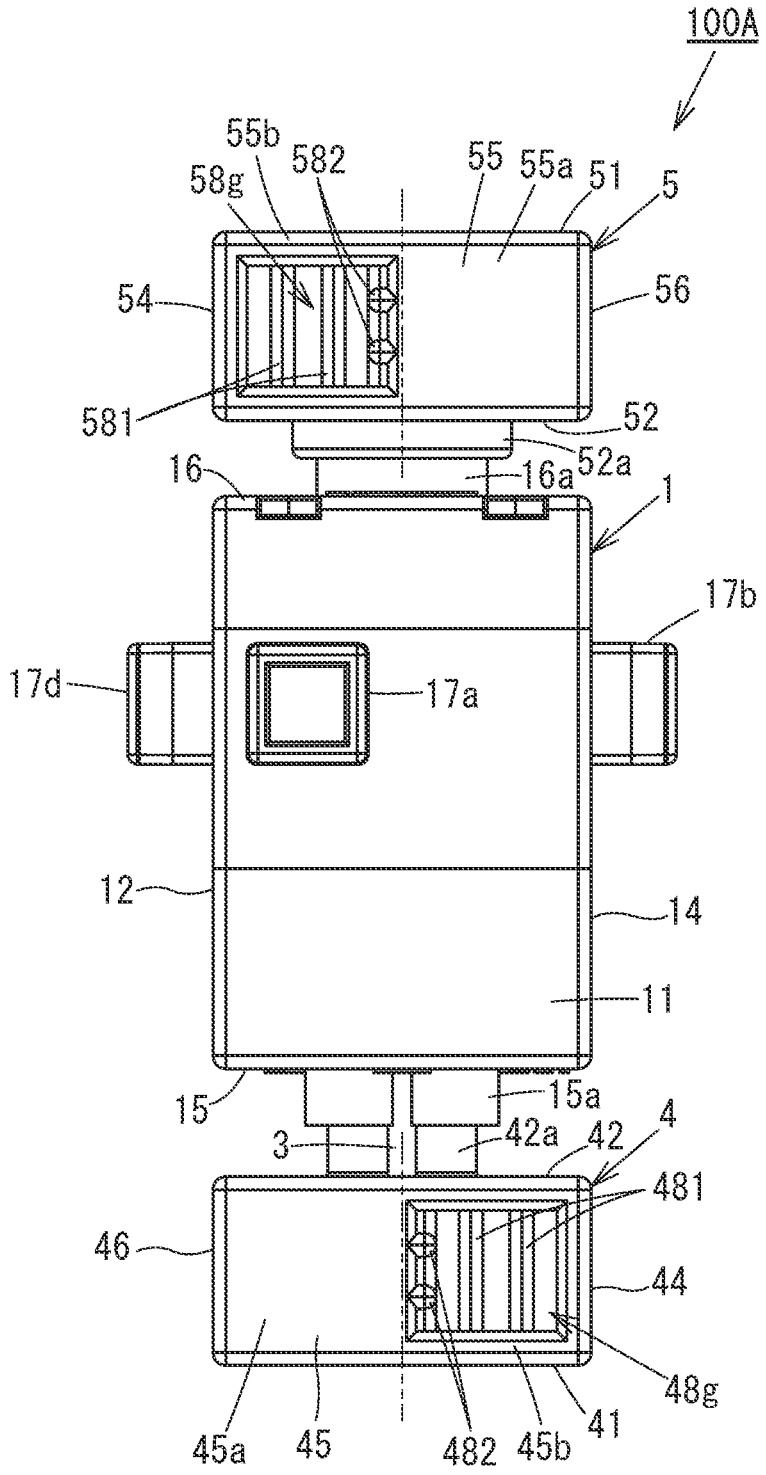
FIG. 5 is a left side view of the assembly block with the servomotor shown in FIG. 1.
Figure 6:
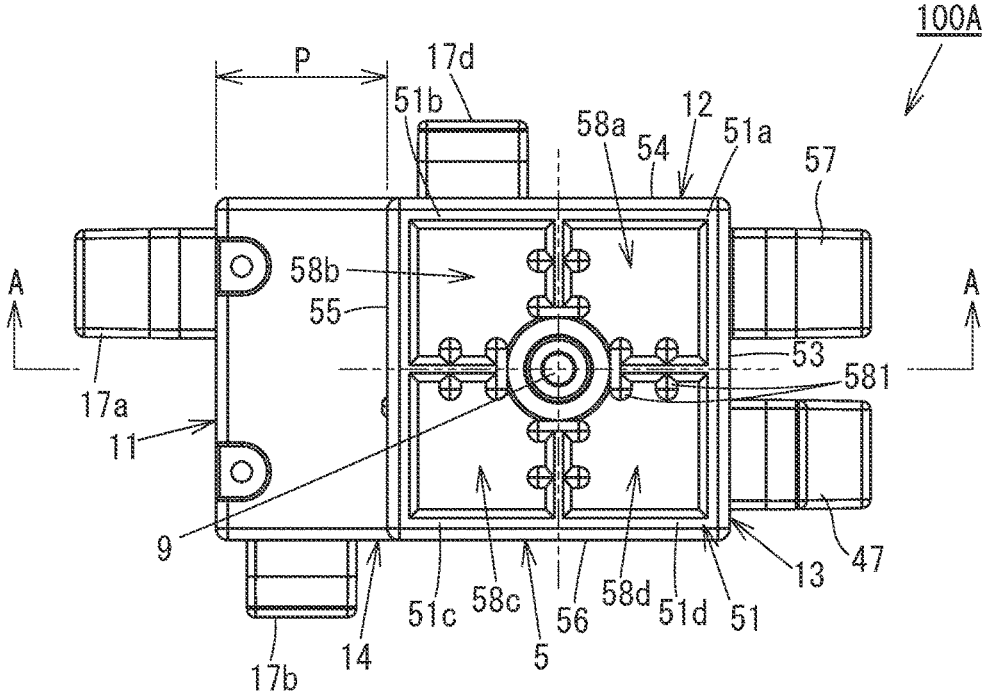
FIG. 6 is a plan view of the assembly block with the servomotor shown in FIG. 1.

As shown in FIG. 4, the side surface 43 includes a protrusion 47 and a recessed portion 48*e*. The protrusion 47 is formed in a rectangular cylindrical shape such that an outer peripheral surface and an inner peripheral surface thereof have substantially square cross sections, and protrudes perpendicularly to the side surface 43. As shown by virtual lines (alternate long and two short dashes lines) in FIG. 4, if the side surface 43 is equally divided into two squares each having a length of P along each side to form sections 43*a* and 43*b*, the protrusion 47 is provided in the center of the section 43*a*, which is one of the two sections 43*a* and 43*b*, such that the diagonal lines of the section 43*a* coincide with the diagonal lines of a square that forms the cross section of the outer surface of the protrusion 47. In addition, the pitch between the adjacent square sections of the outer surface 41 and the pitch between the adjacent square sections of the side surface 43 are equal to the length P of each side of the sections, and equal to the pitch P between the connection means (recessed portion and protrusion) adjacent to each other on the same surface of the basic blocks 200 to 800 shown in FIG. 15.

The recessed portion 48*e* of the side surface 43 has an opening portion having a substantially square shape, and shares a cubic inner space with the recessed portion 48*d* of the outer surface 41. The recessed portion 48*e* is provided in the section 43*b*, i.e., the other one of the two virtual sections 43*a* and 43*b* of the side surface 43, such that the protrusion fitted into the recessed portion 48 is located in the center of the section 43*b* by the rib 481 and the rib 482 and the direction of insertion of the protrusion is perpendicular to the side surface 43.

Similarly to the side surface 43, the side surfaces 44, 45, and 46 are each equally divided into two square sections, and recessed portions 48*h*, 48*g*, and 48*f* similar to the recessed portion 48*e* are formed in the sections 44*b*, 45*b*, and 46*b*, each being one of the two square sections, while the sections 44*a*, 45*a*, and 46*a*, each being the other one of the two square sections, are formed in flat surfaces having neither recessed portions nor protrusions, respectively.

Figure 8:
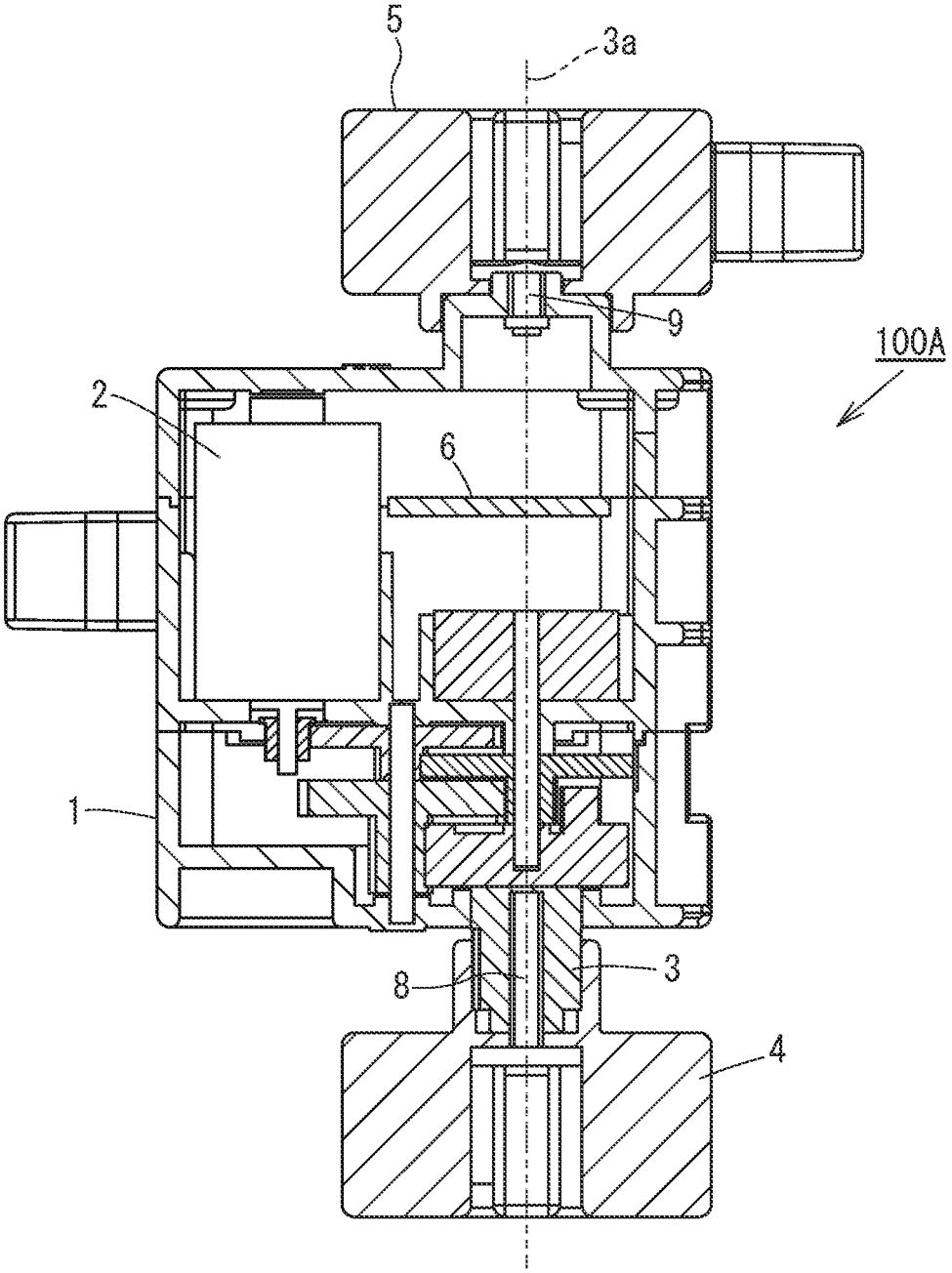
FIG. 8 is a cross-sectional view taken along a line A-A in FIG. 6.

The floating block 5 is provided on the sixth surface 16 of the block main body 1 at the opposite side from the fifth surface 15 of the block main body 1 on which the rotary block 4 is provided. The floating block 5 includes a cylindrical cover 52*a* to be externally fitted to a cylindrical cover 16*a* on the sixth surface 16 of the block main body 1. All the parts of the floating block 5, except the cover 52*a*, are identical in shape to those of the rotary block 4. The parts of the floating block 5, identical in shape to those of the rotary block 4, are denoted by reference numerals, the head digits of which are changed from 4 to 5, and description thereof will be omitted. The floating block 5 is rotatably supported by a supporting screw 9 screwed onto the block main body 1 through a through-hole (not shown) provided in the center of the inner surface 52 thereof. The rotary block 4 and the floating block 5 rotate around an axial center 3*a* of the rotation shaft 3 as shown in FIG. 8.

The protrusions 17*a* to 17*d*, 47, and 57 and the recessed portions 48*a* to 48*h* and 58*a* to 58*h* of the assembly block 100A with the servomotor are formed to be fitted to the recessed portions and the protrusions of the basic blocks 200 to 800 shown in FIGS. 15A to 15H. Regarding protrusions 17*a* to 17*d* of the block main body 1 and the protrusion 57 and the recessed portions 58*e* to 58*h* provided on the side surfaces of the floating block 5, if a first rectangle R1 has, as vertexes, the center of any of the protrusions 17*a* to 17*d* and the center of any of the protrusion 57 and the recessed portions 58*e* to 58*h*, the longitudinal side and the lateral side of the first rectangular R1 each have a length equal to an integral multiple of the pitch P between the connection means adjacent to each other in the same plane of the basic blocks 200 to 700. For example, in FIG. 2, if the first rectangle R1 has, as a diagonal line, a line segment connecting the center of the protrusion 17*b* of the block main body 1 and the center of the recessed portion 58*f* of the floating block 5 and has a longitudinal side parallel to the rotation shaft, a length d1 of the longitudinal side of the first rectangle R1 is 2 P, and a length d2 of the lateral side of the first rectangle R1 is P.

In addition, regarding the protrusion 47 or the recessed portions 48*e* to 48*h* on the side surface of the rotary block 4 and the protrusion 57 or the recessed portions 58*e* to 58*h* on the side surface of the floating block 5, when the connection direction of the protrusion 47 or any of the recessed portions 48*e* to 48*h* is made coincide with that of the protrusion 57 or any of the recessed portions 58*e* to 58*h* and these protrusions or recessed portions are viewed in the connection direction, if a second rectangle R2 has, as a diagonal line, a line segment connecting the center of the protrusion 47 or any of the recessed portions 48*e* to 48*h* and the center of the protrusion 57 or any of the recessed portions 58*e* to 58*h* and has a longitudinal side parallel to the rotation shaft, the longitudinal side and a lateral side of the second rectangle R2 each have a length equal to an integral multiple of the P.

For example, in the example shown in FIG. 4, if the second rectangle R2 has, as a diagonal line, a line segment connecting the center of the protrusion 57 and the center of the protrusion 47 and has a longitudinal side parallel to the rotation shaft 3 as indicated by virtual lines (alternate long and two short dashes lines), a length d3 of the longitudinal side of the second rectangle R2 is 5 P, and a length d4 of the lateral side of the second rectangle R2 is P.

When the side surfaces of the rotary block 4 or the floating block 5 and the surfaces, of the block main body 1, parallel to the rotation shaft 3 are oriented in the same direction and viewed in the direction parallel to the rotation shaft 3, the distance therebetween is equal to an integral multiple of the P. For example, in the example shown in FIG. 6, the distance between each of the side surfaces 53, 54, and 56 of the floating block 5 and each of the surfaces 13, 12, 14 of the block main body 1 is 0 (0 times the pitch P), and the distance between the side surface 55 and the surface 11 is P. The distance between the outer surface 41 of the rotary block 4 and the outer surface 51 of the floating block 5 is also an integral multiple of the P, and is 6 P in the example of FIG. 2. The side surfaces 43 to 46 of the rotary block 4 and the side surfaces 53 to 56 of the floating block 5 are formed so as to be flush with each other when oriented in the same direction. In the case where the side surfaces 43 to 46 of the rotary block 4 and the side surfaces 53 to 56 of the floating block 5 are formed so as not to be flush with each other, the distance therebetween when oriented in the same direction and viewed in the direction parallel to the rotation shaft 3 is preferably equal to an integral multiple of the P.

Next, the function of the assembly block 100A with the servomotor will be described.

Figure 9:
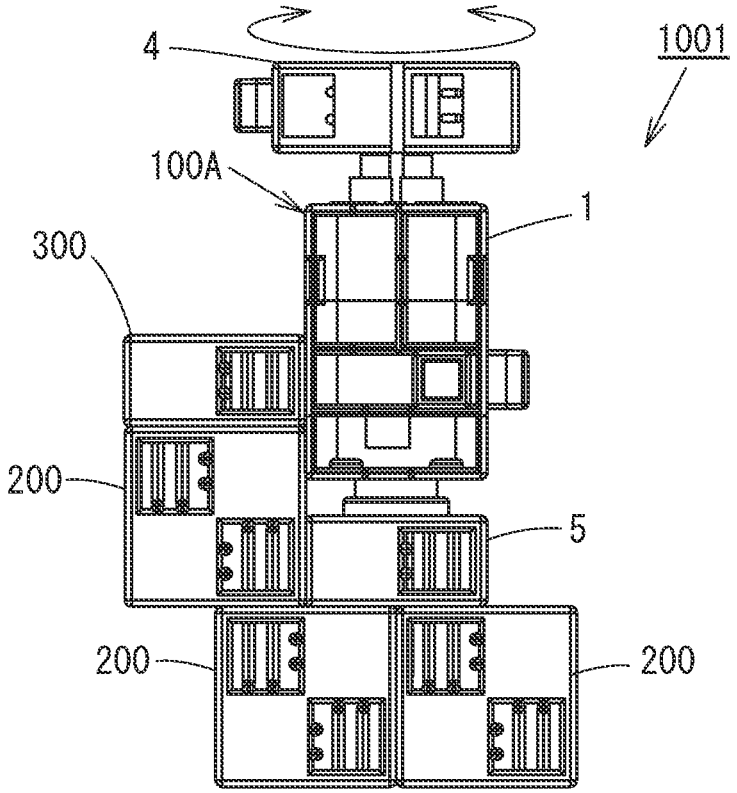
FIG. 9 is a front view of an exemplary work assembled by using an assembly block kit shown in FIGS. 15A to 15H.

FIG. 9 shows an exemplary assembly 1001 formed by using the assembly block kit 1000. In the exemplary assembly 1001, the block main body 1 and the floating block 5 are connected and fixed by using the basic blocks 200 and 300. Therefore, when the servomotor 2 is driven, only the rotary block 4 rotates while the block main body 1 and the floating block 5 are standstill.

In the assembly block 100A with the servomotor, the protrusions 17*a* to 17*d* of the block main body 1 and the protrusion 57 and the recessed portions 58*e* to 58*h* on the side surfaces of the floating block 5 are formed such that the longitudinal side and the lateral side of the first rectangle R1 each have a length equal to an integral multiple of the P, and the distance between the side surfaces 53 to 56 of the floating block 5 and the surfaces 11 to 14 of the block main body 1, when oriented in the same direction, is equal to an integral multiple of the P. Therefore, similarly to the exemplary assembly 1001, the floating block 5 and the block main body 1 can be connected to each other by using any of the basic blocks 200 to 700.

Figure 10:
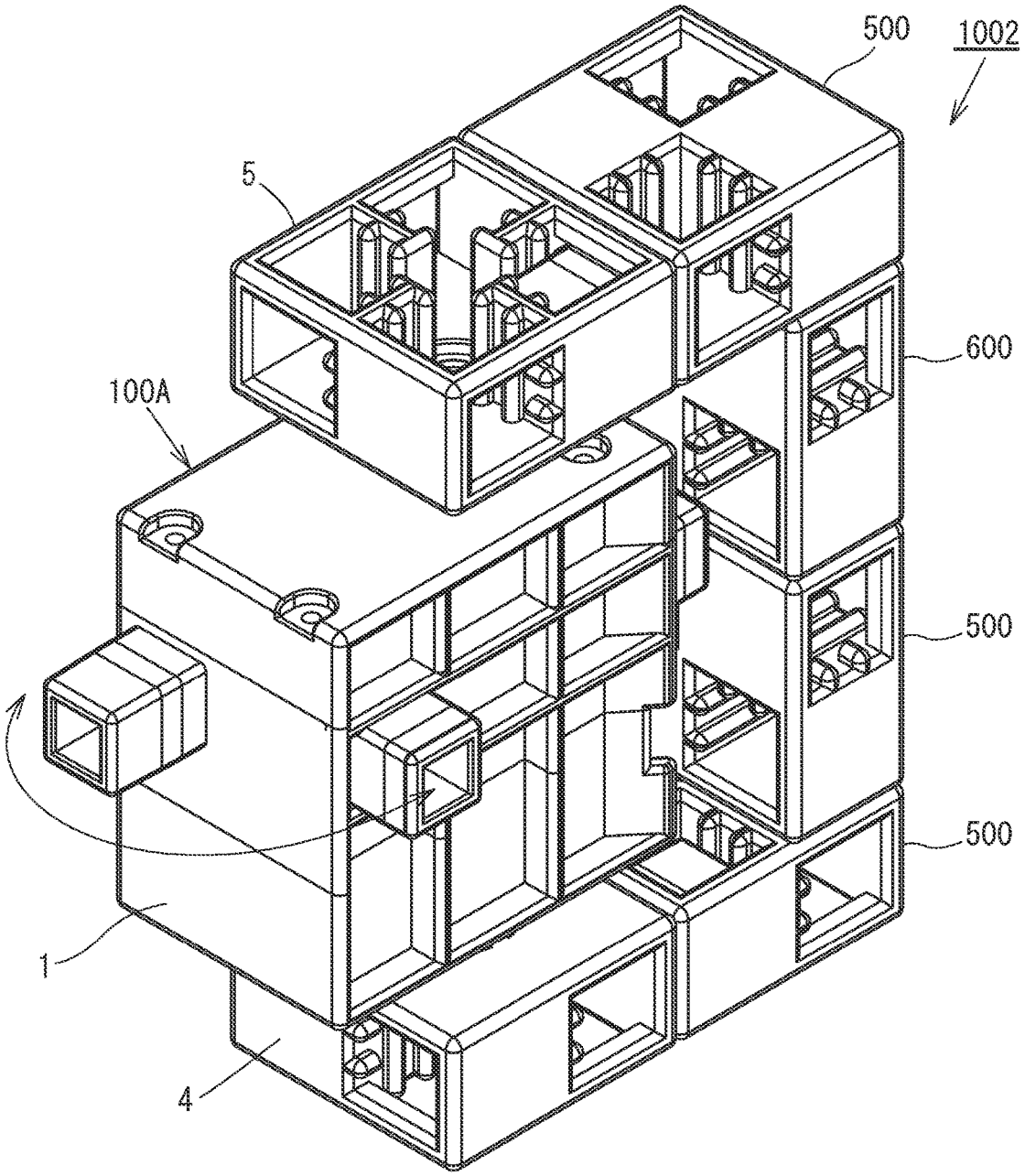
FIG. 10 is a perspective view of another exemplary work assembled by using the assembly block kit shown in FIGS. 15A to 15H.

FIG. 10 shows an exemplary assembly 1002 formed by using the assembly block kit 1000. In the exemplary assembly 1002, the rotary block 4 and the floating block 5 are connected and fixed to each other by using the basic blocks 500 and 600. Therefore, when the servomotor 2 is driven, only the block main body 1 rotates as shown by an arrow in FIG. 10 while the rotary block 4 and the floating block 5 are standstill. In the case where both the rotary block 4 and the floating block 5 are fixed as described above, since the rotary block 4 and the floating block 5 are mutually freely rotatable, these blocks 4 and 5 can be fixed to other assembly blocks in desired directions without being mutually constrained.

In the assembly block 100A with the servomotor, not only the outer surfaces 41 and 51 but also the side surfaces 43 to 46 and 53 to 56 have the recessed portions and the protrusions. Therefore, the blocks can be assembled into various shapes, and various manners of rotations can be realized. Thus, combination of the various shapes and the various manners of rotations allows a user to enjoy various types of works. In addition, the rotary block 4 and the floating block 5 can be directly connected to other blocks located in the axial direction of the rotation shaft 3 and to other blocks located in the direction perpendicular to the rotation shaft 3.

Further, the protrusion 47 or the recessed portions 48*e* to 48*h* of the rotary block 4 and the protrusion 57 or the recessed portions 58*e* to 58*h* of the floating block 5 are formed such that the longitudinal side and the lateral side of the second rectangle each have a length equal to an integral multiple of the P, and the side surfaces 43 to 46 of the rotary block 4 are flushed to the side surfaces 53 to 56 of the floating block 5, respectively. Therefore, the rotary block 4 and the floating block 57 can be connected to each other by using the basic blocks 200 to 700.

Figure 11:
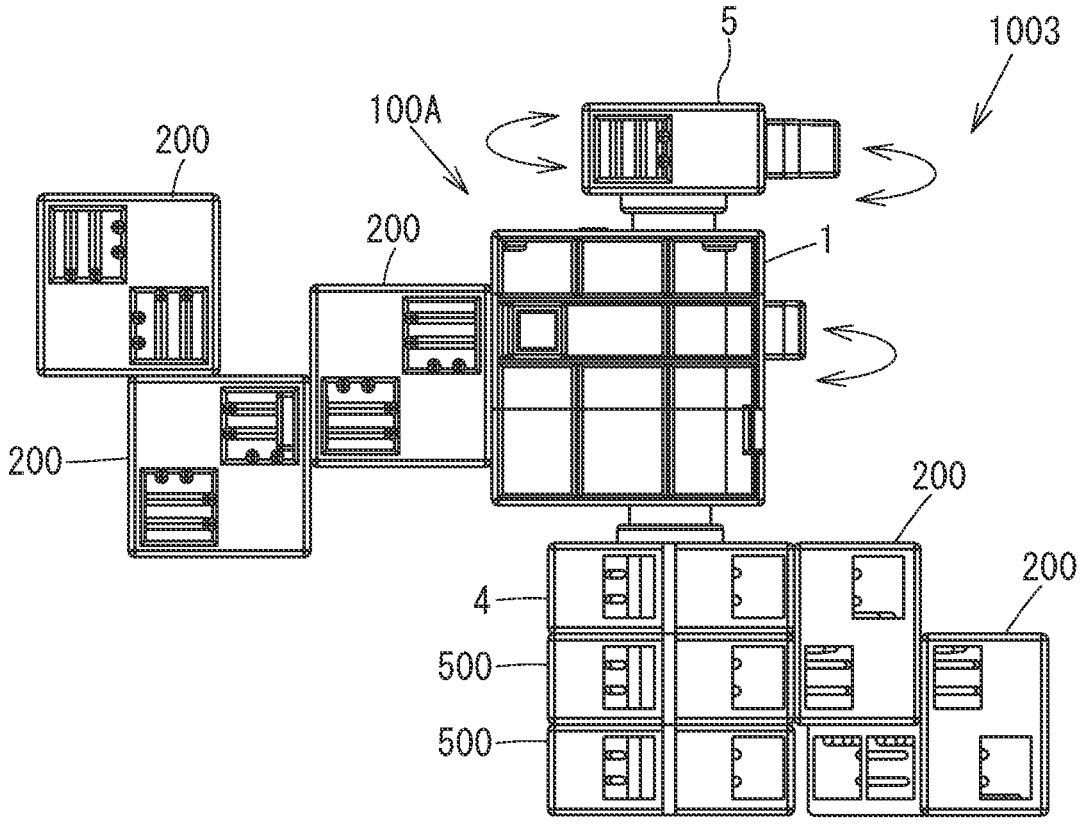
FIG. 11 is a front view of still another exemplary work assembled by using the assembly block kit shown in FIGS. 15A to 15H.

FIG. 11 shows an exemplary assembly 1003 formed by using the assembly block kit 1000. In the exemplary assembly 1003, only the rotary block 4 is fixed to a base assembled by using the basic assembly blocks 200 and 500. Therefore, when the servomotor 2 is driven, the block main body 1 and the floating block 5 rotate while the rotary block 4 is standstill.

When any of the basic blocks 200 to 800 is connected to the third surface 13 of the block main body 1, the electric wiring 7 is housed in the cutout parts 18*a* and 19*a* as shown in FIG. 12, whereby the basic block connected to the third surface 13 can be in contact with the ribs 18 and 19 without a gap.

Figure 13B:
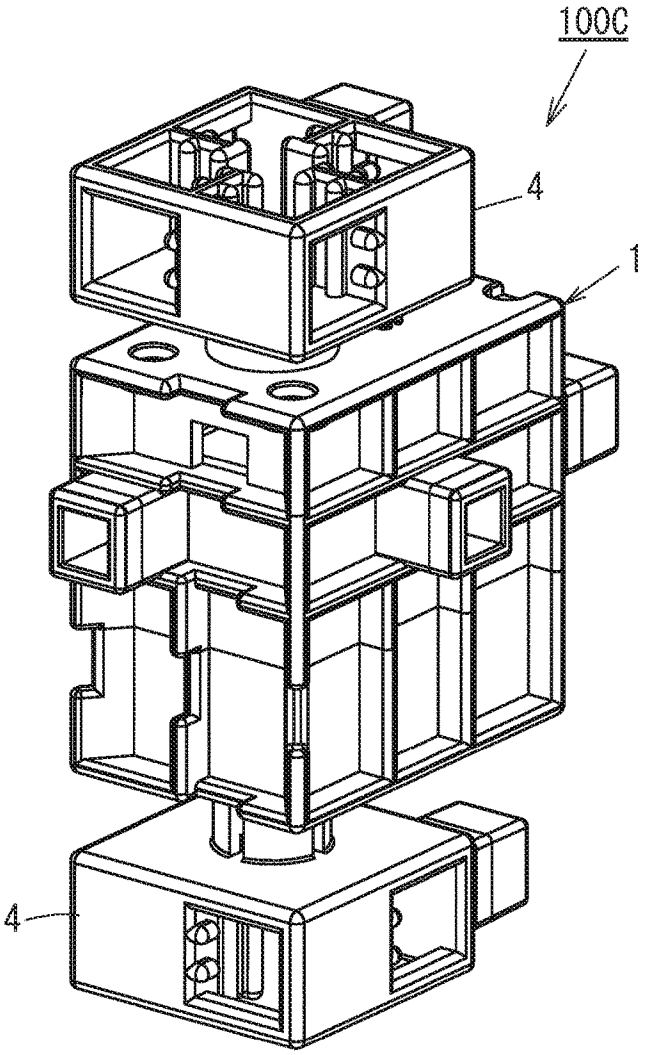
FIGS. 13A and 13B are respectively a perspective view of an assembly block with a servomotor according to another embodiment of the present invention.
Figure 13A:
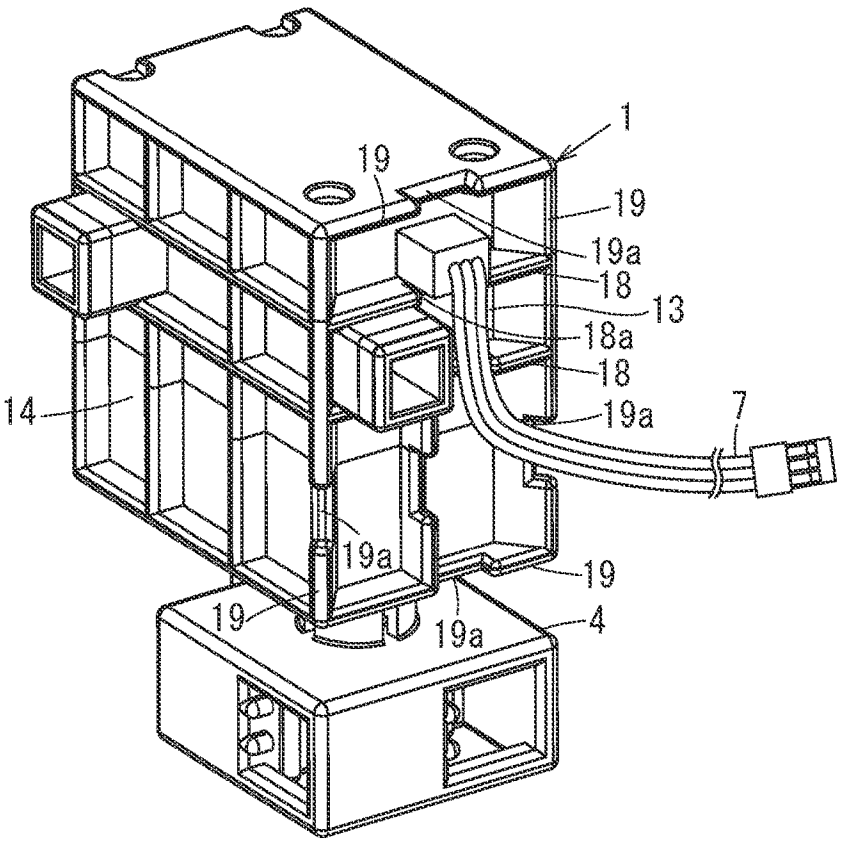

The present invention is not limited to the embodiment described above. For example, an assembly block 100B with a servomotor as shown in FIG. 13A, having only a rotary block 4 and having no floating block, is also within the scope of the present invention. Alternatively, an assembly block 100C with a servomotor as shown in FIG. 13B, having two rotary blocks 4 that rotate together with a rotation shaft, is also within the scope of the present invention.

Figure 14C:
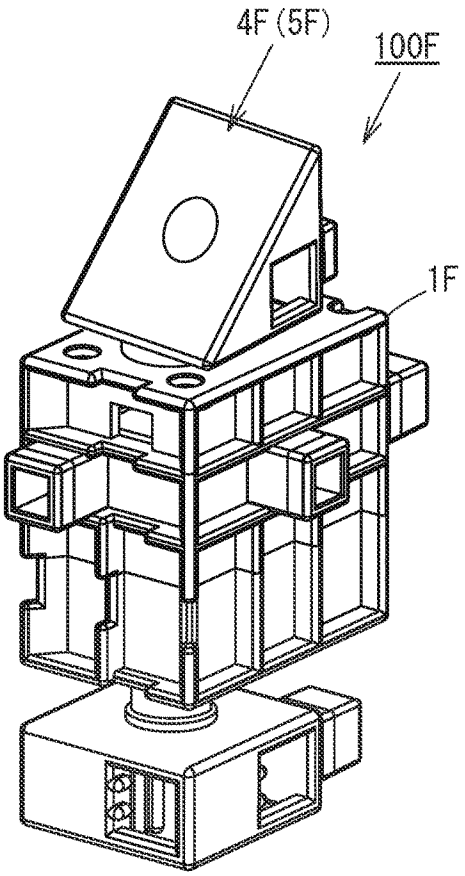
FIGS. 14A, 14B and 14 C are respectively a perspective view of an assembly block with a servomotor according to still another embodiment of the present invention.
Figure 14B:
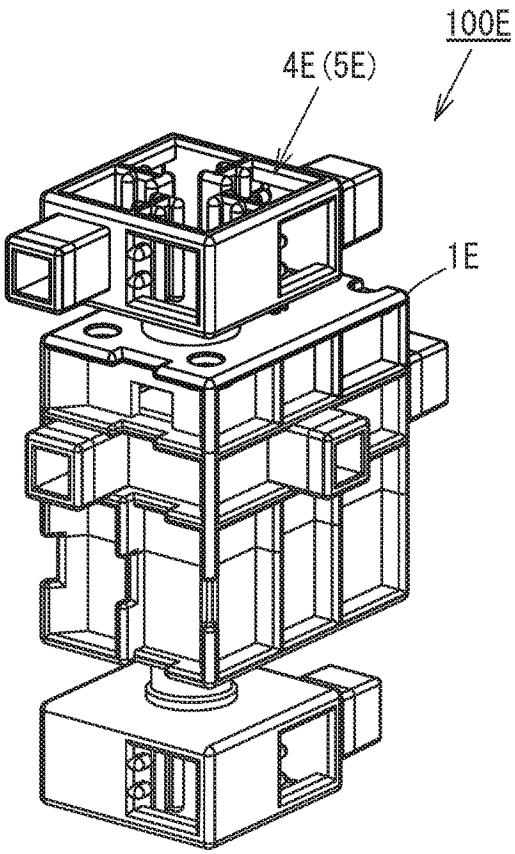
Figure 14A:
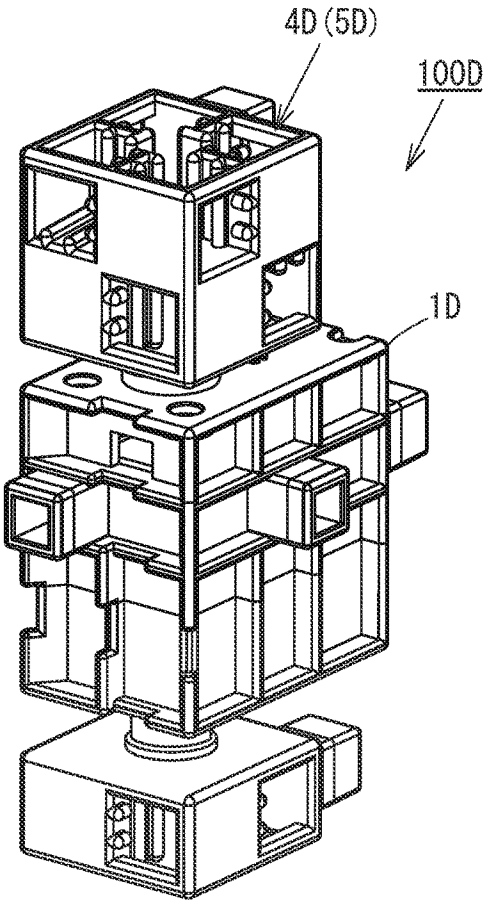

The shape of the rotary block is not limited to the shape described above. The rotary block (or the floating block) may have various shapes, such as shapes denoted by reference numerals 4D, 4E, and 4F (or 5D, 5E, and 5F) in FIGS. 14A, 14B and 14C. The shape of the block main body is not limited to a rectangular parallelepiped. Besides polyhedrons such as a rectangular parallelepiped and a triangle pole, any known stereoscopic shape may be adopted without departing from the gist of the present invention. The block main body may have recessed portions instead of protrusions, or may have both protrusions and recessed portions.

The invention claimed is:

1. An assembly block with a servomotor, comprising:

a block main body having, on a surface thereof, at least one connector comprising a protrusion or a recessed portion;

a servomotor in the block main body;

a rotation shaft which is configured to be rotationally driven by the servomotor;

a rotary block which is fixed to an end of the rotation shaft at a first side of the block main body and configured to rotate together with the rotation shaft; and a floating block which is rotatably supported by the block main body and configured to rotate around an extension which protrudes externally from the block main body at a second side of the block main body, wherein:

the assembly block with the servomotor is connectable to a basic block which is defined as a rectangular parallelepiped, and has, on surfaces thereof, connectors comprising at least one protrusion and at least one recessed portion by fitting the at least one connector of the block main body to one or more of the connectors of the basic block, the rotary block is defined as a polyhedron, and has, on a surface thereof, at least one connector comprising a recessed portion or a protrusion, the rotary block has at least one side surface parallel to the rotation shaft, and has at least one connector on the side surface, the floating block is defined as a polyhedron, and has, on a surface thereof, at least one connector comprising a protrusion or a recessed portion, and the floating block is configured to rotate independently of the block main body and the rotation shaft; and wherein the block main body has:

a first rib along each of at least two of four sides of an outer periphery of the surface of the block main body from which electric wiring extends, the first rib having a cutout part for housing the electric wiring, and at least one second rib which intersects the first rib inside the surface of the block main body from which the electric wiring extends.

2. An assembly block kit comprising:

a basic block which is defined as a rectangular parallelepiped, and has, on surfaces thereof, connectors comprising at least one protrusion and at least one recessed portion; and the assembly block with the servomotor according to claim 1, wherein:

each of the surfaces of the basic block is defined as a rectangle comprising a plurality of square sections arranged side by side, each of the plurality of square sections having a length of P along each side, each of the connectors of the basic block is positioned in a center of one of the plurality of square sections, and includes at least one set of a protrusion and a recessed portion which are respectively positioned in two of the plurality of square sections not opposed to each other, the at least one connector of the block main body is configured to be fitted to the at least one protrusion or the at least one recessed portion of the basic block, and the at least one connector of the block main body has a connection direction perpendicular to the rotation shaft, and when the connection direction of the at least one connector of the block main body is parallel to a connection direction of the at least one connector on the surface of the floating block, the block main body and the floating block are positioned such that a rectangle is defined that has: (i) a longitudinal side with a length equal to an integral multiple of P, (ii) a lateral side with a length equal to an integral multiple of P, and (iii) a diagonal connecting a center of the at least one connector of the block main body and a center of the at least one connector on the surface of the floating block, wherein the longitudinal side of the rectangle is parallel to the rotation shaft.

3. An assembly block kit comprising:

a basic block which is defined as a rectangular parallelepiped, and has, on surfaces thereof, connectors comprising at least one protrusion and at least one recessed portion; and the assembly block with the servomotor according to claim 1, wherein:

each of the surfaces of the basic block is defined as a rectangle comprising a plurality of square sections arranged side by side, each of the plurality of square sections having a length of P along each side, each of the connectors of the basic block is positioned in a center of one of the plurality of square sections, and includes at least one set of a protrusion and a recessed portion which are respectively positioned in two of the plurality of square sections not opposed to each other, the at least one connector of the block main body is configured to be fitted to the at least one protrusion or the at least one recessed portion of the basic block, each of the at least one connector on the side surface of the rotary block and the at least one connector on the surface of the floating block includes at least one protrusion and at least one recessed portion, and when a connection direction of the at least one connector on the side surface of the rotary block is parallel to a connection direction of the at least one connector on the surface of the floating block, the rotary block and the floating block are positioned such that a rectangle is defined that has: (i) a longitudinal side with a length equal to an integral multiple of P, (ii) a lateral side with a length equal to an integral multiple of P, and (iii) a diagonal connecting a center of the at least one connector on the side surface of the rotary block and a center of the at least one connector on the surface of the floating block, wherein the longitudinal side of the rectangle is parallel to the rotation shaft.

* * * * *